United States Patent [19]

Lelental et al.

[11] 4,113,484

[45] Sep. 12, 1978

[54] ELECTROPHOTOGRAPHIC ELEMENTS AND PROCESSES

[75] Inventors: Mark Lelental, Penfield; William Andrew Light, Rochester, both of N.Y.

[73] Assignee: Eastman Kodak Company, Rochester, N.Y.

[21] Appl. No.: 824,136

[22] Filed: Aug. 12, 1977

[51] Int. Cl.[2] ..... G03G 15/24

[52] U.S. Cl. ..... 96/1 R; 96/1.5 R; 96/27 R; 96/48 PD; 204/15; 96/68; 250/315 R

[58] Field of Search ..... 96/1 R, 1.5, 48 PD, 96/48 HD, 1 E; 250/315; 204/1 S

[56] References Cited

U.S. PATENT DOCUMENTS

| | | | |
|---|---|---|---|
| 3,829,317 | 8/1974 | Case | 96/48 PD |
| 3,893,854 | 7/1975 | Honjo et al. | 96/48 PD X |

*Primary Examiner*—John D. Welsh

*Attorney, Agent, or Firm*—Arthur H. Rosenstein

[57] ABSTRACT

A positive image is formed by imagewise passing a current through a substantially uniform layer of physically developable catalyst having a coverage of $1 \times 10^{-6}$ to $1 \times 10^{-10}$ g/cm$^2$. The catalytic ability of the catalyst layer is destroyed by subjecting the image areas to greater than $1 \times 10^{-8}$ coulombs/cm$^2$. Physical development of the thus exposed catalyst layer produces the positive image. A photoconductive element which is useful in this process is also disclosed. This photographic element comprises:

(1) a non-catalytic conductive support;

(2) a substantially uniform first layer coated on the conductive support comprising a physically developable catalyst having a coverage of $1 \times 10^{-6}$ to $1 \times 10^{-10}$ g/cm$^2$ of support;

(3) a photoconductive second layer separated from the first layer by an air gap of up to 20 microns; and (4) a conductive layer over the second layer wherein at least the conductive support (1) or the conductive layer (4) is transparent to the electromagnetic radiation to which the photoconductive second layer (3) is sensitive.

19 Claims, 1 Drawing Figure

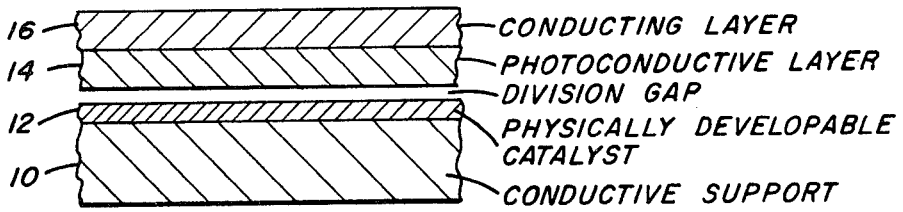
16
14
12
10
CONDUCTING LAYER
PHOTOCONDUCTIVE LAYER
DIVISION GAP
PHYSICALLY DEVELOPABLE CATALYST
CONDUCTIVE SUPPORT

ELECTROPHOTOGRAPHIC ELEMENTS AND PROCESSES

BACKGROUND OF THE INVENTION

1. Field of the Invention

The present invention relates to photographic elements and processes. More particularly, this invention relates to the art of electrophotography and to an element and process for producing positive images.

2. Description of the Prior Art

Photoconductors have been used in a variety of ways to produce photographic images. In one type of process, an activated photoconductor is used to alter an image-forming material. In another type of process, the photoconductor is used to create an imagewise electric field or imagewise current which can be used to form an image.

In U.S. Pat. No. 3,784,375 to Gilman and Kaukeinen, there is described a process wherein an electrostatic charge pattern exposes silver halide to produce a silver metal latent image. The electrostatic charge pattern is formed by imagewise exposing a uniformly charged photoconductive layer. The photoconductive layer is then brought into contact with a layer containing silver halide. The silver halide layer is then conventionally processed to form a negative visible image.

In U.S. Pat. No. 3,660,087 to Kaspaul, there is described a process wherein an activated photoconductor produces nucleation sites in a material comprising an actinic radiation sensitive material such as zinc oxide and a metallic compound such as cuprous oxide. The resulting latent image is developed to a negative visible image by contacting the element with a vapor of the imaging material. A similar process is described in British Pat. No. 1,314,238.

If a photoconductor is placed in an electric field and then imagewise exposed, an imagewise pattern of electric field is produced. The imagewise pattern of electric field will, of course, produce an imagewise current provided the materials in the field are sufficiently conductive. The imagewise electric current or the field can be used to produce a negative image in a suitable material. For example, the current can be used to expose a silver salt as is described in copending application Ser. No. 624,815, filed Oct. 22, 1975; or the field can be used to enhance the sensitivity of a suitable material such as described in U.S. Pat. No. 3,316,088 to Schaffert. In this latter patent, a decomposable reactive component is simultaneously subjected to imagewise light exposure and an imagewise electric field. The imagewise electric field enhances the photosensitivity of the reactive component. A typical reactive component according to the teaching of this patent is silver azide.

In U.S. Pat. No. 3,898,458 to Reithel, there is described a process where a pigment such as titanium dioxide is activated by an imagewise current flow formed by exposing an inorganic photoconductor to X-rays. The pigment and its support and the photoconductor and its support form a composite element at the time of exposure. The activated pigment is then physically developed. The activated pigment is not itself catalytic but reduces heavy metal salts from the physical developer solution to form metal images which are catalytic. In some embodiments, the activated pigment must be contacted with a separate nucleating agent in order to produce catalytic sites for physical development. The nucleating agent is typically a simple solution of silver nitrate. A positive image can be formed using this process by initially overall activating the pigment either by light exposure or uniform charging. Depending on the polarity of the photoconductor during a subsequent exposure of the composite element, the pigment can be imagewise inactivated.

In another type of process, an electric field is used to transport a reactant and thereby form an image. A typical example of a process of this type is described in U.S. Pat. No. 3,457,069 to Robillard. According to the process of this patent, ions are transported into a semiconductive layer by an electric field. The ions initiate a chain reaction which forms a colored image in the semiconductor layer. The ions may be formed from a mixture of a metal salt, such as silver halide, with a metal oxide such as cuprous oxide. A positive image can be formed when photoelectrons from a light source imagewise neutralize metal ions. In the image areas, there are no metal ions to be transported by the electric field and a positive image results.

Since photoconductive imaging has a very high potential for resolution, there is a continuing need for inexpensive and simple elements and processes for use in photoconductive imaging.

SUMMARY OF THE INVENTION

It has been discovered that a certain amount of electric current will destroy the catalytic ability of a physically developable catalyst. In one aspect of our invention, there is provided a photographic element comprising:

(1) a non-catalytic conductive support;

(2) a substantially uniform first layer coated on the conductive support comprising a physically developable catalyst having a coverage of $1 \times 10^{-6}$ to $1 \times 10^{-10}$ g/cm$^2$ of support;

(3) a photoconductive second layer separated from the first layer by an air gap of up to 20 microns; and (4) a conductive layer over the second layer wherein at least the conductive support (1) or the conductive layer (4) is transparent to the electromagnetic radiation to which the photoconductive second layer (3) is sensitive.

In another aspect of our invention, there is provided a process of preparing an image in an element having a substantially uniform layer comprising a physically developable catalyst having a coverage of $1 \times 10^{-6}$ to $1 \times 10^{-10}$ g/cm$^2$ comprising the steps of:

(1) imagewise destroying the developability of the catalyst by subjecting the image areas of the catalyst layer to greater than $1 \times 10^{-8}$ coulombs/cm$^2$; and (2) developing the catalyst layer by physical development.

The image area of the catalyst layer can be subjected to greater than $1 \times 10^{-8}$ coulombs/cm$^2$ in a variety of ways, one of which is by applying a voltage across the element described above of at least about $1 \times 10^5$ volts/cm up to the dielectric breakdown potential of the catalyst and photoconductive layers and then exposing the photoconductive layer to electromagnetic radiation while the voltage is being applied so as to subject the image areas of the catalyst layer to a charge exposure greater than $1 \times 10^{-8}$ coulombs/cm$^2$.

In preferred embodiments, the catalyst layer and the photoconductive layer of the element of the present invention can be separated after the catalytic ability of the catalyst layer is imagewise destroyed. Thus, the photoconductive layer may be used repeatedly. The nonreusable portion of the elements of the present invention, namely the conductive support having the catalyst layer coated thereon, is a simple and inexpensive element to produce. The element of the present invention may be handled in room light, only becoming light sensitive after dark adaptation and the application of the voltage. The exposed element can be processed in a wide variety of developers including well-known electroless plating developers, as well as various dye-forming developers to produce a high resolution positive image. Further, the elements of the present invention are extremely stable in long term storage before charge exposure.

BRIEF DESCRIPTION OF THE DRAWING

The FIGURE is a schematic representation of an element of the present invention.

DETAILED DESCRIPTION OF THE DRAWING AND THE PREFERRED EMBODIMENTS

The elements of the present invention can take a wide variety of configurations, and the drawing illustrates a preferred configuration. There is provided a conductive support 10 having coated thereon a substantially uniform layer 12 of physically developable catalyst. A photoconductive layer 14 is provided over the physically developable catalytic layer 12. Photoconductive layer 14 is between layer 12 and conducting layer 16.

The layer 14 can be applied to the layer 12 in a variety of ways so long as an air gap exists between the two layers. Thus, a solvent cast coating of layer 14 onto layer 12 is not an acceptable method of application. Generally, the layer 14 with its conductive layer 16 is merely sandwiched with layer 12 in contiguous face-to-face relationship. Although layer 12 and layer 14 are in face-to-face relationship, an air gap exists between the two layers owing to the roughness of the surfaces. In some cases, it may be desirable to fasten the layer 12 to layer 14 at the edges at a specified distance, if a more substantial air gap is preferred. Spaces of defined thickness can be built into the surface of either layer 12 or layer 14 such as by adding glass beads or polymeric beads to either or both of these layers. Other methods of forming an air gap between the layers are well known in the art.

The thickness of the air gap is generally determined by the roughness of the layers 12 and 14. Generally, an air gap of up to about 20 microns is satisfactory. The preferred air gap is from about 0.1 micron to about 10 microns.

In the illustrated and described embodiment of the element of the present invention, the element is exposed through conductive layer 16 while a voltage is applied between the conductive layer 16 and the conductive support 10. In this embodiment, conductive layer 16 must be substantially transparent. The photoconductor becomes conductive in the image areas and an imagewise current is set up through the physically developable catalyst layer. In other embodiments, not illustrated, the photoconductor can be exposed through the physically developable catalyst layer which, because of its low coverage, can be substantially transparent. In this embodiment, the conductive support must also be transparent. It will be readily appreciated that a variety of embodiments are within the scope of the present invention so long as it is possible to imagewise expose the photoconductive layer so as to form an imagewise current through the physically developable catalyst layer.

Physically developable catalysts which are useful in the present invention include nuclei of metals from group Ib and VIII of the periodic table and catalytic binary compounds. Typical examples of physically developable nuclei include nuclei of copper, silver, gold, palladium, platinum and the like. Useful catalytic binary compounds include the copper phosphide compounds described in *Research Disclosure,* December, 1973, No. 11663. As described therein, the copper phosphide may be prepared chemically by heating an aqueous copper chloride solution with sodium hypophosphite. Alternatively, the copper phosphide can be prepared photochemically by irradiating cupric hypophosphite with ultraviolet light.

The coverage of the physically developable catalyst should be between $1 \times 10^{-6}$ to $1 \times 10^{-10}$ g/cm$^2$. Coverages lower than $1 \times 10^{-10}$ g/cm$^2$ will not provide enough catalyst to catalyze the imaging reaction in the non-image areas of the element. Coverages much above $1 \times 10^{-6}$ g/cm$^2$ will require excessive amounts of exposure in the image areas in order to destroy the catalytic ability of the catalyst.

Any method of forming a substantially uniform layer of physically developable catalyst is useful in the practice of the present invention. One convenient method is to uniformly vacuum evaporate metal nuclei onto the conductive support. The preparation of vacuum deposited metallic nuclei and a method for determining their coverage is described in J. F. Hamilton and P. C. Logel, Thin Solid Films, 23, 89 (1974), the disclosure of which is hereby incorporated by reference. Another convenient method for forming substantially uniform layers of physically developable catalyst is to form a coating composition which contains a photosensitive or heat sensitive compound of the desired nuclei or binary compound in a suitable binder. After coating on the conductive support, the resulting layer is given an overall exposure to light or heat to form a substantially uniform layer of physically developable catalyst. Where a photosensitive compound is used in this manner, sufficient compound should be used in the coating composition to provide a coverage of physically developable nuclei or binary compound of $1 \times 10^{-6}$ to $1 \times 10^{-10}$ g/cm$^2$ after the compound is uniformly exposed. Useful photosensitive and/or heat sensitive compounds include silver halide, including silver chloride, silver bromide, silver bromoiodide and the like. Useful techniques for producing silver halide emulsions are described in Product Licensing Index, Volume 92, December, 1971, publication 9232, pages 107 through 110.

Palladium nuclei may be generated by the exposure of a wide variety of photosensitive palladium complexes. Palladium complexes which are useful in forming the catalytic nuclei of this invention are described, for example, in Yudelson et al, U.S. Pat. No. 3,719,490; copending application Ser. No. 567,668, filed Apr. 4, 1975, entitled "Physical Development of Pd (II) Photosensitive Complexes"; and B. F. Nellis, *Research Disclosure* 13705, September, 1975. Useful complexes include $(K_2Pd(C_2O_4)_2)$; $[Pd(P(C_6H_5)_3)_2C_2O_4]$; and [Pd (1,1,7,7-tetraethyldiethylene-triamine)$N_3$] $(B(C_6H_5)_4)$.

Similarly, copper nuclei may be generated by the exposure of a wide variety of photosensitive copper complexes. Useful light sensitive copper complexes are described, for example, in Gysling, U.S. Pat. Nos. 3,880,724; 3,860,550; 3,860,501; and 3,859,092.

The photoconductive layer can comprise any of a wide variety of organic or inorganic photoconductors. Preferred photoconductive layers are those that are capable of allowing the passage of a current of at least $1 \times 10^{-8}$ amp/cm$^2$ when exposed. While the total amount of charge that is passed through the catalyst is what is critical to the destruction of the catalytic ability of the physically developable catalyst, for practical purposes, the total charge should be passed in a reasonable amount of time. Thus, the exposed photoconductive layer should be capable of passing a current as described above. It will be understood, however, that in some cases a photoconductor which provides a lesser current than $1 \times 10^{-8}$ amp/cm$^2$ would be useful provided that longer exposure times are tolerable. The photoconductive layer current referred to above relates to the current that is generated when a voltage gradient of at least about $1 \times 10^5$ volts/cm is applied across the conductive support 10 and the conductive layer 16. This current can easily be determined by one skilled in the art using well-known methods.

Typical examples of useful organic photoconductors are described in U.S. Pat. Nos.: 3,240,597; 3,180,730; 3,274,000; 3,542,547; 3,542,544; 3,615,402; 3,265,496; 3,526,501; 3,533,786; 3,542,546; 3,527,602; 3,567,450; 3,615,414; 3,615,418; 3,418,116; and 3,408,181-190. Useful photoconductors also include those described in: Belgian Pat. No. 728,563; Canadian Pat. No. 818,539; and U.S. Defensive Publication No. T881,022. Useful inorganic photoconductors include selenium, sulfur, lead sulfide, tetragonal lead oxide such as described in U.S. Pat. No. 3,577,272 and other inorganic photoconductors including those listed in U.S. Pat. No. 3,121,006. The disclosure of all of these references are hereby incorporated by reference. The aggregate type photoconductors, such as those described in U.S. Pat. No. 3,615,414, are particularly useful.

In some embodiments, the photoconductive layer, described as layer 14 above, can be a self-supporting layer such as a photoconductor in a suitable binder. In these embodiments, the conducting layer 16 is simply coated with the photoconductive layer. Alternatively, in preferred embodiments, the photoconductive layer can be coated on a conductive support. The conductive layers and conducting support can be any of those described below as the support for the physically developable catalyst layer.

Suitable support materials for the physically developable catalyst layer or where necessary the photoconductive layer, can include any of a wide variety of electrically conducting supports. By electrically conducting it is meant that the support, or at least a conductive layer on the support, has a resistivity less than $10^{12}$ ohm cm. The conducting surface of the support should also be non-catalytic for the subsequent development step. By "non-catalytic" it is meant that the support alone will not catalyze physical development. The support can be made non-catalytic by either choosing a conductive material which itself is non-catalytic or by overcoating an otherwise catalytic material, such as a catalytic metal, with a thin barrier layer.

The thin barrier layer can prevent the physical developer from contacting an otherwise catalytic support. Where vacuum evaporated catalytic nuclei are used as the physically developable catalyst, the coverage of the catalyst layer is so low that the catalyst layer is not continuous. If the support were catalytic, contacting the element with the developer would not only develop an image where the physically developable catalyst remains undestroyed but also where the developer contacted the support. In embodiments where the substantially uniform layer of physically developable catalyst is formed by uniformly exposing to radiation a light sensitive compound in a binder, the developable composition could permeate through the binder to the support and, if it were catalytic, the support would cause a substantially uniform deposition of imaging material. Thus, the thin barrier layer, if present, should be thick enough so as to protect the support from contacting the developer solution but should be thin enough so that the required current can be passed through the physically developable catalyst layer to the support. Any film-forming polymer will form a suitable barrier layer. An example of a suitable barrier layer is a $1 \times 10^{-4}$ mm layer of poly(methylacrylate-co-vinylidene chloride-co-itaconic acid) which is described in U.S. Pat. No. 3,271,345.

The conducting support can be, for example, various conducting papers such as barium sulfate (baryta) coated paper, aluminum coated paper and aluminum paper laminates; metal foils such as aluminum foil, zinc foil and the like; metal plates such as aluminum, copper, zinc, brass and galvanized plates; vapor deposited metal layers such as silver, nickel or aluminum on conventional glass or film supports such as cellulose acetate, poly(ethylene terephthalate), polystyrene and like conducting supports. A particularly useful conducting support can be prepared by coating a support material such as poly(ethylene terephthalate) with a layer containing a semi-conductor dispersed in a resin as described in U.S. Pat. No. 3,254,883 or vacuum deposited on the support. Likewise, suitable conducting coatings are described in U.S. Pat. Nos. 3,007,901; 3,245,883 and 3,267,807.

The conductive support 10 and/or the conductive layer 16 must be transparent to the electromagnetic radiation used to expose the photoconductor. Thin metal coatings are known in the art to form conductive coatings which are transparent to visible light. Metals which form such coatings include gold, aluminum, chromium, nickel, copper and the like. Other suitable visible light transparent conductive supports are described in the patents mentioned above for forming conductive layers. Preferred transparent conductive layers are coatings containing nickel or a 50:50 mixture of chromium and silicon oxide.

As used herein, "coated on a conductive support" and similar terms mean that the layer coated is coated in contact with a conductive surface of the support.

The process of the present invention is most conveniently carried out using the element described above. However, a photoconductive element need not be used to provide the imagewise current that destroys the catalytic ability of the physically developable catalyst. For example, the catalytic ability could be destroyed by "writing" with an electrode on an element having a layer of physically developable catalyst on a conductive support. In short, any method of subjecting the image areas of the catalyst layer to a charge exposure greater than $1 \times 10^{-8}$ coulombs/cm$^2$ is useful in the present process. The total charge through the image areas of the catalyst layer can be conveniently measured using an electrometer and an integrating capacitor using methods well known to those skilled in the art.

When a photoconductive layer is used to provide the imagewise current, the photoconductive layer should be dark adapted before being exposed where necessary.

Some photoconductors, such as lead oxide, require relatively long periods to become dark adapted. Others, such as most organic photoconductors, need no dark adaptation. By dark adapted, it is meant that the photoconductor in the dark passes less than $1 \times 10^{-8}$ amp/cm$^2$ in an electric field of $1 \times 10^5$ volts/cm.

During exposure of the photoconductor, a voltage of at least 300 V is applied across the photoconductive layer-physically developable catalyst layer composite. Any higher voltage can be applied up to the dielectric breakdown potential of the layers. The preferred applied voltage is between about $3 \times 10^5$ volts/cm and $30 \times 10^5$ volts/cm. The voltage is conveniently applied using a direct current source; however, rectified alternating current can be used so long as the peak voltage is at least $1 \times 10^5$ volts/cm across the layers.

Some photoconductors retain conductivity even after the exposure to electromagnetic radiation is terminated. When these photoconductors are used, an imagewise current can be produced by applying the voltage after the exposure is terminated. In preferred embodiments, however, imagewise exposure of the photoconductor while the voltage is simultaneously applied produces the desired imagewise current. The particular exposing radiation necessary depends on the particular photoconductor. Exposure with applied voltage is continued long enough so that the image areas of the physically developable catalyst layer are subjected to a charge exposure greater than $1 \times 10^{-8}$ coulombs/cm$^2$. Again, the length of exposure depends on the particular photoconductor and other factors but exposure times of 0.01 to 60 seconds are typical.

An exposed element can be processed in a variety of ways by physically developing the catalyst layer. For example, a processing composition can be discharged in the air gap between the photoconductive layer and the physically developable catalyst layer. In this embodiment, the element need not be delaminated. In preferred embodiments, however, it is desirable to separate the photoconductive layer from the physically developable catalyst layer so that the photoconductive layer can be reused to form another image. In these embodiments, the physically developable catalyst layer can be processed by any of a wide variety of methods. A particularly suitable method is to simply immerse the conductive support-physically developable catalyst layer element into a physical development bath. The physical development bath generally contains a salt of a heavy metal ion, a complexing agent for the heavy metal ion and a reducing agent for the metal ion. In other embodiments, the physically developable catalyst layer can be overcoated with a viscous solution or a dried layer of a physical developer composition; it can be contacted with an amplification element containing a redox image forming composition in a binder; or by any other suitable method.

Useful heavy metal physical developers, also sometimes referred to as electroless plating baths, are described, for example, in Hornsbee, Basic Photographic Chemistry, (1956) 66; Mees and James, The Theory of the Photographic Process, 3rd Edition, (1966), pages 329 through 331; and U.S. Pat. No. 3,650,748 and the like. All of these references are hereby incorporated by reference.

The preferred metal salts useful in the physical developer are water soluble salts such as silver nitrate, cupric salts such as copper chloride, copper nitrate, copper sulfate, copper formate, copper acetate and the like, and nickel salts such as nickel chloride, nickel bromide, nickel sulfate, nickel nitrate, nickel formate and the like.

Typical reducing agents used in the physical developer include, for example, polyhydroxy-substituted aryl compounds such as hydroquinones, catechols and pyrogallols; ascorbic acid derivatives; amino-phenols; p-phenylenediamines, and the like developing agents used in the photographic art. Particular examples of reducing agents for physical developer solutions are 2-methyl-3-chlorohydroquinone, bromohydroquinone, catechol, 5-phenyl-catechol, pyrogallol monomethyl ether (1-methoxy-2,3-dihydroxybenzene) and 5-methylpyrogallol monomethyl ether, isoascorbic acid, N-methyl-p-aminophenol, dimethyl-p-phenylene diamine, 4-amino-N,N-di(n-propyl)aniline and 6-amino-1-ethyl 1,2,3,4-tetrahydroquinoline. Borane reducing agents such as amineboranes, borohydride, and the like may also be used.

The preferred physical development baths include the Copper Enplate developer baths (a trademark of Enthone Inc.) containing copper sulfate, formaldehyde, Rochelle salt, and nickel sulfate.

The physical developer solutions in addition to the metal salt, reducing agent, and complexing agent for the metal salt such as Rochelle salt or other ligands for the metal salt, can include a variety of other materials to facilitate maintenance and operation of the developer and to improve the quality of the developed image, such as acids and bases to adjust pH, buffers, preservatives, thickening agents, brightening agent, and the like. The rate of development can be increased and hence the time of development decreased, by adding to the developer solution a surfactant such as an alkyl metal salt of a sulfated fatty acid, e.g., dodecyl sodium sulfate.

Where the element is processed by overcoating the physically developable catalyst layer with a physical developer composition, the overcoat can be any of a wide variety of heat activatable compositions. These compositions are described, for example, in U.S. Pat. Nos. 3,152,904; 3,300,678; and 3,392,020; British Pat. Nos. 1,110,046; 1,131,108; 1,161,779; 1,342,523 and 1,346,252; and German Pat. No. 888,045.

The heat activatable physical developer compositions comprise a source of silver ion, which is believed to be an oxidizing agent which reacts with a reducing agent, the reaction being catalyzed by the physically developable catalyst. This silver salt oxidizing agent should be resistant to darkening under illumination to prevent undesired deterioration of a developed image. Preferably, the silver salt oxidizing agent is a long-chain fatty acid. "Long chain", as employed herein, is intended to mean a chain of carbon atoms containing at least 10 carbon atoms, typically 10 to 30 carbon atoms. An especially useful class of silver salt oxidizing agents is the silver salts of long-chain fatty acids containing at least 20 carbon atoms. Compounds which are useful silver salts of long-chain fatty acids are, for example, silver behenate, silver stearate, silver oleate, silver laurate, silver hydroxystearate, silver caprate, silver myristate, silver palmitate and the like.

Other silver salt oxidizing agents which are useful in the present invention include silver benzoate, silver phthalate, silver acetate, silver acid phthalate and the like; silver phthalazinone, silver benzotriazole, silver saccharin and the like.

A particularly useful source of silver ion is a dispersion of the silver complex of the ligand 3-carboxy-methyl-4-methyl-4-thiazoline-2-thione. The dispersion of this complex with a reducing agent to form a heat activatable physical developer composition is described in U.S. Pat. No. 3,785,830, issued Jan. 15, 1974, the disclosure of which is hereby incorporated by reference.

The physical development solutions and compositions described above typically form a metallic image. Dye images can be formed by contacting the physically developable catalyst layer with a solution or an amplification element containing reducible leucophthalocyanine or a reducible tetrazolium salt and a reducing agent. Processes of this type are described in copending application Ser. Nos. 567,667 and 567,668, both to Gysling and Lelental, filed Apr. 14, 1975, and *Research Disclosure* 15631, Volume 156, hereby incorporated by reference.

The following examples are presented to illustrate the invention and not to limit it in any way.

EXAMPLE 1

Palladium nuclei were vacuum deposited at a coverage of $2 \times 10^{-8}$ g/cm$^2$ upon a sample of barium sulfate coated paper. A photoconductive element was prepared by coating a layer of tetragonal lead oxide photoconductor at a thickness of 90 microns on a nickel coated poly(ethylene terephthalate) support. A composite element was made by contacting the palladium nuclei layer of the first element with the tetragonal lead oxide photoconductive layer of the second element. A voltage of 3 Kv was applied across the composite element by applying the positive polarity of a direct current source to the nickel coated poly(ethylene terephthalate) and the negative polarity to the barium sulfate coated support. The composite element was imagewise exposed for 60 seconds through the poly(ethylene terephthalate) support of the photoconductive element using 60 Kev X-rays filtered through 1 mm of aluminum using a Faxitron 805 self-contained X-ray unit. The barium sulfate coated support having the layer of nuclei was separated from the photoconductive element and developed by a nickel physical developer which was made by mixing (a) and (b) described below:

| | | | |
|---|---|---|---|
| (a) | $NiCl_2 \cdot 6H_2O$ | 3.75 | g |
| | $Na_4P_2O_7 \cdot 10H_2O$ | 7.5 | g |
| | $NH_4OH$ to pH | 10.5 | |
| | Water to make | 100 | ml |
| (b) | monomethylaminehydrazine bisborane | .30 | g |
| | Water to make | 50 | ml. |

A good quality direct positive reproduction, with neutral image tone of the X-rayed metallic object resulted.

EXAMPLE 2

A composite element was prepared and exposed as in Example 1, except that the negative polarity of the direct current source was applied to the nickel coated poly(ethylene terephthalate) support and the positive polarity to the barium sulfate coated paper. After processing as in Example 1, a good quality direct positive reproduction resulted.

EXAMPLE 3

A composite element was prepared and exposed as in Example 1. After separation from the photoconductive element, the remaining catalytic palladium nuclei on the barium sulfate coated support were developed to a direct positive magenta image by development in a physical developer which was formed by mixing equal volumes of 5 grams of 2,3,5-triphenyl-2H-tetrazolium chloride, adjusted with sodium hydroxide to a pH of 12.0 in 100 ml of water; and 3 grams of dimethylamine borane in 100 ml of water.

EXAMPLE 4

Palladium nuclei were deposited on three substrates. Using the photoconductive element described in Example 1, X-ray exposures were made also as described in Example 1. The palladium nuclei were then developed to a magenta color image by the tetrazolium color physical developer described in Example 3. The conductive supports used were evaporated carbon and nickel coated on poly(ethylene terephthalate) and $TiO_2$ coated on paper.

EXAMPLE 5

A composite element was prepared as in Example 1 except that a transparent aggregate photoconductor as described in U.S. Pat. No. 3,615,414 was coated at a coverage of 20 microns on the conductive layer of a poly(ethylene terephthalate) support. The conductive layer was a 50—50 mixture of Cr and SiO applied by vacuum deposition. A voltage of 2 Kv was applied across the composite with a negative polarity being applied to the photoconductive element. Using a tungsten light source with an unfiltered intensity of 15 fc, an optically projected 16mm microimage at 23 times magnification was focused on the photoconductor through the poly(ethylene terephthalate) support of the photoconductive element. The simultaneous voltage application and light exposure was maintained for 5 seconds. The exposed palladium coated barium sulfate paper was separated from the photoconductive element and then developed to a direct positive magenta color image by the color physical developer described in Example 3.

EXAMPLE 6

Copper nuclei were vacuum deposited at a coverage of $4.2 \times 10^{-8}$ g/cm$^2$ onto the conductive layer of a poly(ethylene terephthalate) support. The conductive layer was a 50—50 mixture of Cr and SiO applied by vacuum deposition. The photoconductive element was a 90 micron thick coating of tetragonal lead oxide coated on nickel coated poly(ethylene terephthalate) support. A composite element was prepared with the photoconductive layer contacting the copper nuclei layer. A voltage of 2 Kv was applied across the composite, the positive polarity being applied to the photoconductive element. X-ray exposures were made as in Example 1 and the exposed copper nuclei element was developed by a nickel physical developer as described in Example 1. A direct positive reproduction, with neutral image tone, was produced.

EXAMPLE 7

Silver nuclei were vacuum deposited at a coverage of $6.0 \times 10^{-8}$ g/cm$^2$ onto the conductive layer of a poly(ethylene terephthalate) support. The conductive layer was a 50—50 mixture of Cr and SiO vacuum evaporated on the support. The photoconductive element was a 90 micron thick coating of tetragonal lead oxide photoconductor coated on a nickel coated poly(ethylene terephthalate) support. The silver nuclei element and the photoconductive element were laminated as in Example 1. A voltage of 1.4 Kv was applied to the composite element. While the voltage was being applied, the photoconductor was imagewise exposed through the nickel coated poly(ethylene terephthalate) support using a 30 fc fluoroescent light source and an exposure time of 30 seconds. The exposed silver nuclei element was then delaminated from the photoconductor element and then overcoated with a dry-physical-development 4 mil overcoat having the following composition:

| | |
|---|---|
| 6.5 ml of 1.6:1 | ligand/$Ag^+$ dispersion of silver complex of 3-carboxymethyl-4-methyl-4-thiazoline-2-thione |
| 2.5 ml of 7.2% | solution of t-Butylhydroquinone in methanol |
| 0.5 ml of 0.25% | solution of Mercapto-1,2,4-triazole in methanol |
| 0.15 ml of 0.25% | solution of 2,4-Dimercaptopyrimidine in methanol |
| 0.4 ml of 0.5% | solution of Surfactant 10G (available from Rohm and Haas) |
| 1ml of 5 % | solution of Poly(vinyl alcohol) (Vinol 165 available from Air Products and Chemicals). |

The overcoat was dried and then developed for 4 seconds by heating to 155° C. A good quality direct positive image having a density of about 0.8 resulted.

EXAMPLE 8

A silver nuclei element was exposed as in Example 7. Processing in a nickel physical developer gave a good quality positive reproduction having a density of about 1.0.

EXAMPLE 9

Silver nuclei elements were prepared and exposed as in Example 7. The exposed silver nuclei elements were developed for 10 seconds at 110° C to a direct positive image having a density of about 0.15 by using a 6 mil dry-physical development overcoat having the following composition:

0.16 m silver behenate
0.15 m benzene sulfonamidophenol
0.04 m succinimide
in a 4.38 percent solution of poly(vinylbutryl) in 1:1 acetone-toluene.

The invention has been described in detail with particular reference to preferred embodiments thereof, but it will be understood that variations and modifications can be effected within the spirit and scope of the invention.

What is claimed is:

1. A photographic element comprising:
(1) a non-catalytic conductive support;
(2) a substantially uniform first layer coated on said support, said layer comprising a physically developable catalyst having a coverage of $1 \times 10^{-6}$ to $1 \times 10^{-10}$ g/cm$^2$ of support;
(3) a photoconductive second layer separated from said first layer by an air gap of up to 20 microns; and
(4) a conductive layer over said second layer
wherein at least said conductive support (1) or said conductive layer (4) is transparent to the electromagnetic radiation to which said photoconductive second layer (3) is sensitive.

2. The element of claim 1 wherein said physically developable catalyst is selected from the group consisting of nuclei of metals from groups Ib and VIII of the periodic table and catalytic binary compounds.

3. The element of claim 1 wherein said physically developable catalyst is selected from the group consisting of nuclei of copper, silver, gold, palladium, platinum and copper phosphide.

4. The element of claim 1 wherein said photoconductive second layer is capable of passing a current of at least $1 \times 10^{-8}$ amp/cm$^2$ when a voltage gradient of $10^5$ volts/cm is applied across said conductive support (1) and said conductive layer (4).

5. The element of claim 1 wherein said noncatalytic conductive support comprises a catalytic metal overcoated with a thin non-catalytic barrier layer.

6. The element of claim 1 wherein said layers (3) and (4) consist of a photoconductive layer coated on a conductive support.

7. The element of claim 1 wherein said non-catalytic conductive support is barium sulfate coated paper and said physically developable catalyst is vacuum evaporated palladium nuclei.

8. The element of claim 1 wherein said photoconductive second layer is a layer of tetragonal lead oxide.

9. A photographic element comprising
(1) a non-catalytic conductive support;
(2) a substantially uniform first layer coated on said support, said layer comprising palladium nuclei having a coverage of $1 \times 10^{-6}$ to $1 \times 10^{-10}$ g/cm$^2$ of support;
(3) a second layer comprising tetragonal lead oxide separated from said first layer by an air gap of up to 20 microns; and
(4) a nickel-coated support.

10. A process of preparing an image in an element having a layer comprising a substantially uniform layer of physically developable catalyst having a coverage of $1 \times 10^{-6}$ to $1 \times 10^{-10}$ g/cm$^2$ comprising the steps of:
(1) imagewise destroying the developability of said catalyst by subjecting the image areas of said catalyst layer to a charge exposure greater than $1 \times 10^{-8}$ coulombs/cm$^2$; and
(2) developing said catalyst layer by physical development.

11. A process of preparing an image in an element comprising a conductive support having coated thereon a substantially uniform first layer comprising a physically developable catalyst having a coverage of $1 \times 10^{-6}$ to $1 \times 10^{-10}$ g/cm$^2$ and a second photoconductive layer separated from said first layer by an air gap of up to 20 microns, said process comprising the steps of:
(1) applying a voltage across said element of at least about $1 \times 10^5$ volts/cm up to the dielectric breakdown potential of said layers;
(2) imagewise destroying the developability of said catalyst by imagewise exposing said second layer to electromagnetic radiation while said voltage is being applied so as to subject the image areas of said first layer to a charge exposure greater than $1 \times 10^{-8}$ coulombs/cm$^2$; and
(3) developing said first layer by physical development.

12. The process of claim 11 wherein said photoconductive second layer is coated on a transparent conductive support and said photoconductive layer is imagewise exposed through said support.

13. The process of claim 11 wherein a voltage of between $3 \times 10^5$ volts/cm and $30 \times 10^5$ volts/cm is applied across said element.

14. The process of claim 11 wherein said second photoconductive layer is exposed to electromagnetic radiation while said voltage is applied for between 0.01and 60 seconds.

15. The process of claim 11 wherein the developing step comprises immersing said first layer in a physical developer solution.

16. The process of claim 11 wherein said first layer is coated with a dry-physical-developer after said imagewise exposure and wherein said developing step comprises heating said first layer and said dry-physical-developer.

17. The process of claim 16 wherein said dry-physical-developer comprises a silver salt oxidizing agent and a reducing agent and a source of silver ion.

18. The process of claim 15 wherein said physical developer solution comprises a salt of a heavy metal ion and a reducing agent and a complexing agent for said heavy metal ion.

19. The process of claim 15 wherein said physical developer solution comprises a reducible leucophthalocyanine dye or a reducible tetrazolium salt and a reducing agent.

* * * * *